US006221232B1

(12) United States Patent
Tayama et al.

(10) Patent No.: US 6,221,232 B1
(45) Date of Patent: Apr. 24, 2001

(54) ELECTROLYTIC REFINING METHOD FOR GALLIUM AND APPARATUS FOR USE IN THE METHOD

(75) Inventors: Kenichi Tayama; Nagayasu Yanata; Kishio Tayama, all of Tokyo (JP)

(73) Assignee: Dowa Mining Co., Ltd., Tokyo (JP)

( * ) Notice: Subject to any disclaimer, the term of this patent is extended or adjusted under 35 U.S.C. 154(b) by 0 days.

(21) Appl. No.: 09/428,476

(22) Filed: Oct. 28, 1999

(30) Foreign Application Priority Data

Oct. 30, 1998 (JP) ..... 10-310331
Oct. 30, 1998 (JP) ..... 10-310332

(51) Int. Cl.[7] ..... C25C 3/34

(52) U.S. Cl. ..... 205/367; 205/564; 204/243.1; 204/244; 204/245; 204/247.1; 204/247.2

(58) Field of Search ..... 205/367, 564; 204/243.1, 244, 245, 247.1, 247.2

(56) References Cited

U.S. PATENT DOCUMENTS 4,475,993 * 10/1984 Blander et al. ..... 205/367

FOREIGN PATENT DOCUMENTS 2-50926 2/1990 (JP) .
2-243727 9/1990 (JP) .
6-192877 7/1994 (JP) .

* cited by examiner

*Primary Examiner*—Arun S. Phasge
(74) *Attorney, Agent, or Firm*—McDermott, Will & Emery

(57) ABSTRACT

An electrolytic refining method for gallium by depositing refined gallium on a cathode in an electrolytic solution using a melted raw gallium material as an anode in an electrolytic cell is disclosed, comprising applying a centrifugal force to the melted raw gallium material and discharging out a scum gathered in the central portion of the cell.

10 Claims, 2 Drawing Sheets

ELECTROLYTIC REFINING METHOD FOR GALLIUM AND APPARATUS FOR USE IN THE METHOD

BACKGROUND OF THE INVENTION

1. Field of the Invention

The present invention relates to an electrolytic refining method for gallium and an apparatus for use in the method.

2. Description of the Related Art

Recently, the demand for metallic gallium is increasing because of its use as a raw material for GaAs, GaP, and the like, which are used as compound semiconductor devices and light emitting devices. Gallium is mainly produced as a by-product in a process for producing alumina or for smelting zinc, but, in addition thereto, scraps of semiconductor materials are also available as a raw gallium material.

As methods for refining gallium from such raw gallium materials (i.e., metallic gallium accompanied by impurities), usually well-known are the crystallization refining method, the lifting of single crystals, and the electrolytic refining method.

The crystallization refining method is a method for obtaining solid gallium, which comprises incorporating a seed crystal into the cooling medium during the solidification of the melted raw gallium material, thereby allowing the seed crystal to grow by the cooling effect exerted by the cooling medium and obtaining the refined solid gallium in the thus grown crystalline side. For instance, in Japanese Patent Laid-Open No. 50926/1990 is disclosed a crystallization refining method comprising performing the crystal growth above in multiple steps.

The method of lifting a single crystal is a refining method which comprises bringing the front end of a seed crystal in contact with a melted raw gallium material, and then slowly pulling up impurity-free single crystals having been grown from the seed crystal. For instance, Japanese Patent Laid-Open No. 243727/1990 teaches that the efficiency of refining is improved by forming an acidic solution layer on the surface of melted gallium.

The electrolytic refining method comprises performing electrolysis in an electrolytic solution using a raw gallium material as an anode. In this case, gallium and metals that are electrochemically more basic than gallium elute into the electrolytic solution, while metals that are electrochemically more precious than gallium electrolytically deposit on a cathode together with gallium. Thus, refined metallic gallium can be obtained on the cathode. For example, Japanese Patent Laid-Open No. 192877/1994 discloses a method comprising placing a melted raw gallium material on the bottom of an electrolytic cell and then performing electrolysis between the melted raw material used as an anode and a rod-like cathode. In this case, the metallic gallium deposited on the surface of the cathode drops down in the form of drops and is collected in a receptor provided on the lower side, while impurities such as indium, copper, and lead remain on the anode side.

In the crystallization refining method, the purity of gallium can not be increased unless otherwise repeating the operation. Moreover, because the process is complicated and the productivity is low, in many cases the application of this method is limited to the refinement in a high-purity region, i.e., the method is applied to the use of metallic gallium having a purity of 5N (99.999%) or higher as a raw material in order to obtain a product with a higher purity of 6N or 7N (99.9999% or 99.99999%) or even higher. That is, the method is not suitable for those having a purity of about 2N or 3N because the yield is too low. Also, concerning the method of lifting a single crystal, its application is limited to that in a high-purity region, and furthermore, it has a disadvantage that the facilities are expensive.

In contrast, the electrolytic refining method is simple as compared with the above-described two methods, does not substantially require manual operations and is inexpensive in terms of apparatus. Thus, this method is advantageous in that it is applicable as a low-purity refining method to be performed as a step until the high-purity refining method (i.e., as a pretreatment). However, the related art electrolytic refining method comprises concentrating indium, copper, lead, etc. in an anode and leaving them. Thus, if a predetermined or more amount of impurities are concentrated in the anode, the impurities are incorporated into an electrolytic solution, resulting in lowering the purity of gallium deposited on a cathode. Thus, in case where the purity of the refined gallium is regulated, the electrolysis life is automatically determined. Furthermore, the related art electrolytic refining method involves a problem that "gold" contained in semiconductor scraps, etc. can not be removed therefrom.

SUMMARY OF THE INVENTION

Accordingly, an object of the invention is to develop an electrolytic refining method for gallium capable of removing impurities such as gold, which have not been able to be removed in the related art methods, while increasing a degree of concentration of impurities in an anode and prolonging an electrolysis life, yet taking advantages of the related art electrolytic refining method for gallium, that is inexpensive, simple in process and substantially free of manual operation, and to refine gallium in a high yield.

The present inventors have found that in the electrolytic refining method by depositing high-purity refined metallic gallium on a cathode while using melted metallic gallium containing impurities as an anode, when a centrifugal force is applied to a melted raw gallium material, thereby rotating (rotating around a vertical shaft) it, a scum generated on the anode can be gathered in the center of rotation and that when the scum is discharged out of the system, the electrolysis life can be markedly prolonged as well as gold can be removed.

Specifically, the invention provides an electrolytic refining method for gallium by depositing refined gallium on a cathode in an electrolytic solution while using a melted metallic gallium containing impurities (which is referred herein as a "melted raw gallium material) as an anode, wherein a centrifugal force is applied the melted raw gallium material in the electrolytic solution, thereby rotating (rotating around a vertical shaft) it, and scums gathered in the central portion of thereto are discharged out from an electrolytic cell.

Furthermore, as an apparatus for advantageously conducting the method above, the invention provides an apparatus for use in electrolytic refining of gallium, which comprises an electrolytic cell into which is charged an electrolytic solution maintained at a temperature not lower than the melting point of gallium, the electrolytic cell comprising anodic chamber for containing a melted raw gallium material as an anode and a cathodic chamber for collecting refined gallium deposited in a cathode, and the anodic chamber and the cathodic chamber being partitioned from each other such that the electrolytic solution is communicated between the chambers, wherein the anodic chamber is constructed by a cylindrical vessel for containing the melted raw gallium material, a magnet rotator is provided at a lower side and outside of the cylindrical vessel, and a suction pipe is placed in a central portion inside of the cylindrical vessel, and if desired, the suction pipe is connected to an intermediate cell provided at the outside of the electrolytic cell, and a piping connecting from the intermediate cell to the electrolytic cell via a filter is provided.

Still further, the invention provides an electrolytic refining method for gallium in accordance with the method above, wherein the method further comprises circulating the electrolytic solution into an electrowinning cell provided at the outside of the electrolytic cell and performing an operation of depositing gallium in a cathode of the electrowinning cell, thereby maintaining the concentration of gallium in the electrolytic solution within a predetermined range during the electrolysis. Furthermore, as an apparatus for advantageously conducting the method above, there is provided an apparatus for electrolytic refining for gallium as above, wherein an auxiliary electrolytic cell (the electrowinning cell) having an insoluble cathode and an anode is provided outside the electrolytic cell, and a circuit for circulating the electrolytic solution between the electrolytic cell and the auxiliary electrolytic cell is provided, and if desired, an intermediate cell is provided in the circulating circuit, the intermediate cell is connected with the suction pipe, and a filter is incorporated in the piping connecting from the intermediate cell to the electrolytic cell.

DESCRIPTION OF THE PREFERRED EMBODIMENTS

Figure 1:
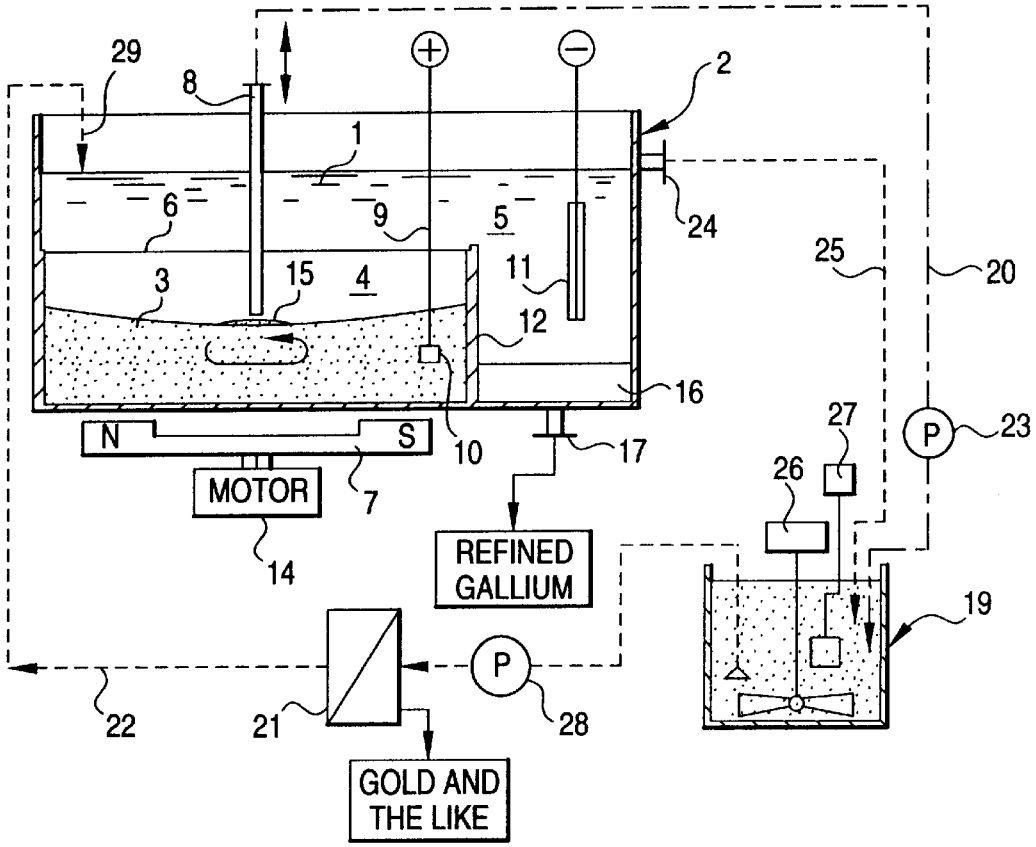
FIG. 1 is a schematic cross-sectional view of an apparatus for conducting the method according to the invention.

The present inventors found that when the melted raw gallium material is rotated (revolved) in the electrolytic solution, black substances are gathered on the surface of the melted raw gallium material corresponding to the central portion of the rotation. Because those substances are colored black, it is presumed that they contain gallium oxides. In the present specification, the substances thus gathered at the center of rotation are called as a "scum". The fact that the scum can be gathered and separated from the melted raw material during the electrolysis provides a special effect that it facilitates removal of an oxide film that generates in the interface between the melted raw gallium material and the electrolytic solution and that it enables removal of gold, because the generation of such an oxide film extremely impairs the efficiency of electrolysis, and gold cannot be separated by a usual electrolytic refining method for gallium.

Then, the present inventors conducted an operation of sucking out the scum gathered on the surface of the melted raw material at the center of rotation by using a suction pipe, and found surprisingly that gold is accompanied and sucked out. The reason for this is not completely clarified, but an oxide of gallium mainly generates on the surface of the melted raw material with the progress of electrolysis, and presumably, this oxide takes up gold more easily than the liquid phase of raw gallium material.

The gold accompanied in the melted raw gallium material, as is described later in the Comparative Examples, does not remain in an anode slime in usual electrolysis. From the viewpoint of standard electrode potential, gold is classified in the most precious region. And, from the electrochemical viewpoint, gold should not elute from the anode into the liquid, i.e., it is not ionized, at the electrolytic potential of gallium. Nevertheless, since gold does not remain in the anode slime, it is presumed that it is dispersed as a colloid in the electrolytic solution by some reason. Thus, it could be considered that fine particles of gold floated in the electrolytic solution in a colloidal state are incorporated at the time when gallium ions undergo electrodeposition at the cathode and included in the refined gallium.

As described above, gold accompanied in the raw gallium material could be hardly removed by usual electrolytic refining, but the invention considerably facilitated the removal of gold by enabling the drawing out of gold together with the scum through the suction pipe. Other impurities such as In, Cu, Pb, etc. behave differently from gold, and are concentrated as an anode slime.

Figure 2:
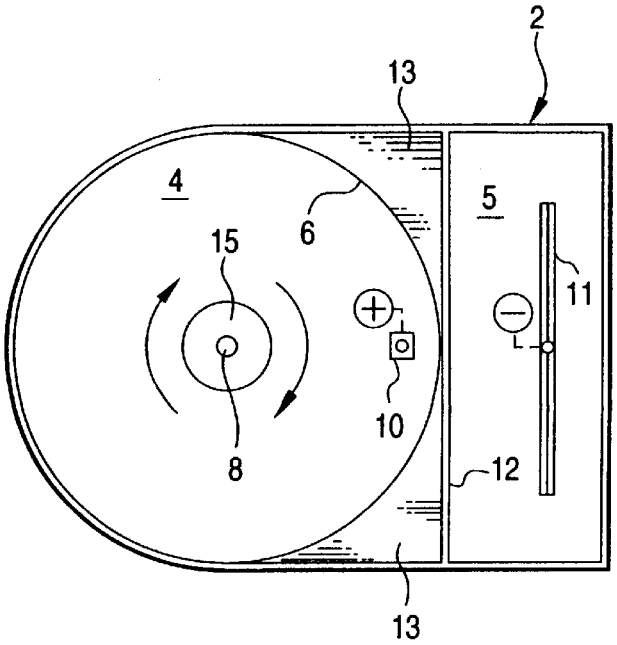
FIG. 2 is a schematic planar view of an electrolytic cell portion of the apparatus shown in FIG. 1.

An embodiment of the invention is described below with reference to the accompanying drawings. FIG. 1 shows a schematic cross-sectional view of an example of the apparatus for conducting the method according to the invention; and FIG. 2 shows a schematic planar view of the electrolytic cell of the present apparatus.

The apparatus comprises an electrolytic cell 2 charged with an electrolytic solution 1 (maintained at a temperature not lower than the melting point of gallium), which is separated into an anodic chamber 4 charged with a melted raw gallium material 3 functioning as an anode, and a cathodic chamber 5 provided for collecting refined gallium deposited on the cathode, wherein the anodic chamber 4 is constituted by a cylindrical vessel 6. A magnet rotator 7 is installed outside of the cylindrical vessel 6 on the lower side thereof, and a suction pipe 8 is placed at the central portion of the cylindrical vessel 6. Ideally, the cylindrical vessel 6 is provided with an inner wall having high circularity, but it may be provided with a polygonal inner wall partially comprising edged walls, or may be provided with an inner plane having a difference in radius for the upper side and the lower side. An electrically conductive rod 9 covered with an insulator comprises a metallic terminal 10 provided on the front edge thereof, and is immersed into the melted raw gallium material 3. Thus, by applying a positive potential to the electrically conductive rod 9, the melted raw gallium material 3 functions as an anode. Separately, a cathode plate 11 is immersed into the electrolytic solution charged inside the cathodic chamber 5, and a negative potential is applied thereto.

The anodic chamber 4 and the cathodic chamber 5 are constituted in such a manner that the electrolytic solution 1 is communicated therebetween. Furthermore, the apparatus shown in the figures is provided on one side of the electrolytic cell 2 in such a manner that the height of the cylindrical vessel 6 constituting the anodic chamber 4 is lower than the liquid level of the electrolytic solution 1, so that the electrolytic solution may communicate between the chambers 4 and 5. A separator plate 12 is provided between the chambers 4 and 5. Similar to the cylindrical vessel 6, the height of the separator plate 12 is also provided lower than the liquid level of the electrolytic solution. Referring to FIG. 2, a lid 13 is provided on a space that is formed between the separator plate 12 and the cylindrical vessel 6, so that a hollow portion is formed in the space lower than the lid 13. A constitution capable of allowing the electrolytic solution 1 to communicate between the anodic chamber 4 and the cathodic chamber 5 is not only limited to the case exemplified above, but, for instance, an independent cathodic chamber may be formed adjacent to the cylindrical vessel forming the anodic chamber, and a communicating path may be provided in the wall separating the both chambers.

The magnetic rotator 7 installed on the outer lower side of the cylindrical vessel 6 is provided in such a manner that it may rotate around the central axis of the vessel 6, and the rotation is enabled by a motor 14. A permanent magnet is used for the rotator 7, and by rotating the magnet in the lower horizontal plane around the axis of the vessel 6, a magnetic force provides a rotational force that is applied to the melted raw gallium material 3 charged into the vessel 6. Thus, a revolving flow generates around the axis of the vessel to provide the centrifugal force.

The suction pipe 8 installed at the central portion of the cylindrical vessel 6 is inserted from the upper portion of the electrolytic cell 2 movably in the upper and the lower directions in the electrolytic solution in such a manner that a suction hole provided at the front end of the suction pipe may be positioned at the center of the surface portion of the revolving melted raw gallium material 3. Accordingly, substances that are present in the center of the surface portion of the melted raw material 3 can be sucked by generating a negative pressure on the suction pipe 8. At the same time, the position of the suction hole provided to the front end of the suction pipe is controlled in such a manner that it enables the suction of the substances that are present only on the surface layer portion of the melted raw material 3.

Because a substance (scum) 15 with a specific gravity lower than the melted raw material is gathered at the center of the surface portion of the revolving melted raw gallium material by the centrifugal force exerted thereto, the scum 15 can be sucked out through the suction pipe 8. Although it is most efficient to suck out the scum 15 alone at this instance, there is no problem in particular even if it accompanies the electrolytic solution 1 or a small amount of the melted raw material 3 so long as the accompanied quantity does not influence the electrolysis.

Meanwhile, metallic gallium deposits on the surface of the cathode plate 11 provided in the cathodic chamber 5. However, by maintaining the electrolytic solution at a temperature not lower than the melting point of gallium, the thus formed deposit of metallic gallium is maintained in the form of a melt and drops downward into a reservoir 16 provided at the lower portion, which is then recovered as refined gallium from a discharge port 17.

In an apparatus provided in the constitution above, the apparatus shown in the figures further comprises an intermediate cell 19 on the outside of the electrolytic cell 2. The intermediate cell 19 is connected by a piping 20 with the suction pipe 8 described above, and another piping 22 is further provided to the intermediate cell 19 to connect it with the electrolytic cell 2 with a filter 21 incorporated therebetween.

The piping 20 is equipped with a pump 23. By driving the pump 23, a negative pressure can be applied to the suction pipe 8 and the fluid (i.e., the scum 15, the electrolytic solution 1, and the melted raw material 3) sucked by the suction pipe can be supplied to the intermediate cell 19. The amount sucked can be controlled by adjusting the revolution of the pump 23, or by stopping and starting the same. Otherwise, a flow control valve (not shown) can be provided to the piping 20 to control the flow rate. As a matter of course, a difference in height can be provided between the intermediate cell 19 and the suction pipe 8 in such a manner that the fluid can be allowed to flow down by a natural force from the head without using the pump 23. In this case, the flow rate is controlled by providing a flow control valve to the piping 20.

Furthermore, an overflow of the electrolytic solution 1 is supplied to the intermediate cell 19 from an overflow outlet 24 of the electrolytic cell 2 via a piping 25, and the electrolytic solution is stored in the intermediate cell 19 together with the fluid supplied from the previously mentioned suction pipe 8. The intermediate cell 19 is provided as a thermostat cell, and is equipped with a stirrer 26 and a heater 27. The fluid inside the cell is stirred with the stirrer 26 while maintaining at a predetermined temperature by using the heater 27. In the example shown in the figures, an immersion heater is used as the heater 27.

The piping 22 is equipped with the filter 21 and a pump 28. By driving the pump 28, the fluid inside the intermediate cell 19 is returned to the electrolytic cell 2. At this time, the discharge edge 29 of the piping 22 (i.e., the cylindrical vessel 6) is provided to the side of the anodic chamber 4 so as to feed the fluid to the upper portion of the melted raw material 3. While conducting the electrolysis, the ref lux of the fluid provided inside the intermediate cell 19 via the piping 22 controls the liquid plane of the electrolytic solution 1 inside the electrolytic cell 2 at a predetermined level (i.e., the level of the overflow outlet 24).

The filter 21 is provided in order to filter off the scum from the fluid. In the apparatus shown in the figures, activated charcoal is used as the filtering material. For the filtering material, also usable are resin filters made of, for example, polypropylene, Teflon, or the like, but the material is not particularly limited so long as the material is alkali-resistant at a temperature of 50° C. Furthermore, referring to FIG. 2, by arranging the left half portion and the right half portion symmetrically with respect to the electrode plate 11 provided as the central axis in such a manner that the anodic chamber 4 having the cylindrical vessel 6 in both sides of the cathodic chamber 5, the processing quantity can be doubled.

Next, the embodiment of operating the method according to the invention by using the apparatus shown in the figures is described below.

The height of the cylindrical vessel 6 and the separator plate 12 is not limited in particular, but it is preferred that it is set at about one third of the height of the liquid level of the electrolytic solution 1, so that the electrolytic solution 1 may freely flow between the anodic chamber 4 and the cathodic chamber 5. An aqueous NaOH solution is used as the electrolytic solution 1, which is provided at a concentration in a range of from 100 to 200 g/liter, preferably, at about 150 g/liter. If the concentration of NaOH is lower than 100 g/liter, the potential between the electrodes increases, thereby lowering the purity of the refined gallium. On the other hand, if the concentration is higher than 200 g/liter, the concentration of the impurities that are incorporated into the liquid increases, thereby similarly lowering the purity of the refined gallium. The temperature of the electrolytic solution is preferably in a range of from 35 to 70° C., and more preferably, in a range of from 50 to 65° C. If the temperature is lower than 35° C., the potential between the electrodes increases, whereas a temperature higher than 70° C. has no effect in elevating the efficiency of the electrolysis, but may impair the quality of the material and the like constituting the electrolytic cell. In the apparatus shown in the figures, the temperature of the electrolytic solution is controlled by the heater 27 provided in the intermediate cell 19. Since the melting point of gallium is 29.9° C., the temperature inside the intermediate cell 19 must be maintained at a temperature not lower than this temperature.

While maintaining the electrolytic solution under the conditions as described above, a proper amount of melted raw gallium material 3 is fed into the cylindrical vessel 6 provided in the anodic chamber 4, and an electric current is applied to the melted raw material by using the melted raw material 3 as the anode and the cathode plate 11 while exerting a centrifugal force by rotating the magnet rotator 7. In this case, the current supply is controlled as such that the current density is maintained in a range of from 0.02 to 0.2 $A/cm^2$, preferably, in a range of from 0.05 to 0.1 $A/cm^2$. If the current density is lower than 0.02 $A/cm^2$, the electrolysis does not proceed, and if the current density exceeds 0.2 $A/cm^2$, the purity of the refined gallium decreases.

By continuously exerting the centrifugal force by rotating the melted raw material 3 around the central axis using the magnet rotator 7 during the electrolysis, substances (scum 15) having a specific gravity lower than that of metallic gallium are gathered on the surface at the central portion of the melted raw material 3. The revolution of the magnet rotator 7 is controlled to adjust the rotation of the melted raw material in such a manner that the scum 15 may concentrate most favorably. Since the scum 15 is colored black as compared with the melted raw material, the manner of concentration on the surface to the central portion can be understood by visual observation.

As described above, the scum 15 gathered to the center contains gallium oxides and may further include some oxides of the impurities that are present in the melted raw material 3. However, although gold hardly undergoes oxidation, and hence, no gold oxides should be present, the scum 15 sucked by the suction pipe 8 accompanies gold.

In sucking up the scum 15 concentrated to the center by means of the suction pipe 8, the suction hole in the front end of the suction pipe 8 is positioned slightly higher than the scum 15, so that the scum 15 may be taken up together with the electrolytic solution 1 while excluding the melted raw material 3. In this manner, most of the scum 15 thus generated can be taken up together with the electrolytic solution, moreover, with the gold accompanying thereto, except for the unavoidably taken up melted raw material.

In the apparatus shown in the figures, the scum 15 accompanying the gold and sucked together with the electrolytic solution enters into the intermediate cell 19, and while being stirred, it is heated by the heater 27 together with the electrolytic solution supplied from the overflow piping 25 to the intermediate cell 19. In this manner, there is obtained a fluid comprising an electrolytic solution having mixed therewith and suspended therein the scum, gold, and a small quantity of melted raw gallium material being maintained at a predetermined temperature. The fluid is fed back to the electrolytic cell 2 through the piping 22, while the temperature and the flow rate of this reflux are controlled by operating the heater 27 and the rotation of the pump 28 in such manner that they may comply with the temperature and the quantity of the electrolytic solution required in the electrolytic cell 2. This operation can be automatically controlled.

In this reflux process, the suspended portion of the fluid is filtered off from the fluid by using the filter 21. The substance obtained as the filter residue accompanies gold. The gold thus recovered accounts for most part of the gold being mixed in the melted raw gallium material. Thus, the concentration of gold for the anode slime can be greatly lowered, and hence, the concentration of gold in the refined gallium obtained as a deposit on the cathode can be extremely lowered. By thus lowering the concentration of gold in the refined gallium, the load of the subsequent process in obtaining gallium of high purity can be considerably lowered. The fact that gold can be removed from gallium by the method according to the invention is extremely advantageous in the production of high purity gallium.

As described above, gold that is incorporated into the melted raw gallium material 3 is removed by the filter 21, and the impurities, for instance, In, Cu, Pb, etc., that are also incorporated in the melted raw gallium material 3 are concentrated in the anode slime. As a result, the refined gallium recovered into the reservoir 16 of the cathodic chamber 5 is obtained as a high-purity metallic gallium almost free of Au, In, Cu, Pb, etc. Also, because the scum comprising the oxides, which generates on the surface of the melted raw gallium material, is removed, troubles ascribed to the generation of such oxide films such as the break out (i.e., the interruption of the electrolysis) can be prevented from occurring. More specifically, for instance, the oxide film may function as an insulating layer as to abruptly increase the potential between the electrodes, and in such a case, gallium of low purity may form electrodeposits on the cathode if electrolysis is continued without taking any counter measures. But this can also be avoided, and the life of electrolysis can be prolonged. Furthermore, since the anode slime is obtained with low concentration of impurities such as In, Cu, and Pb, the electrolysis can be operated at high efficiency and yet, with high refining yield.

Figure 3:
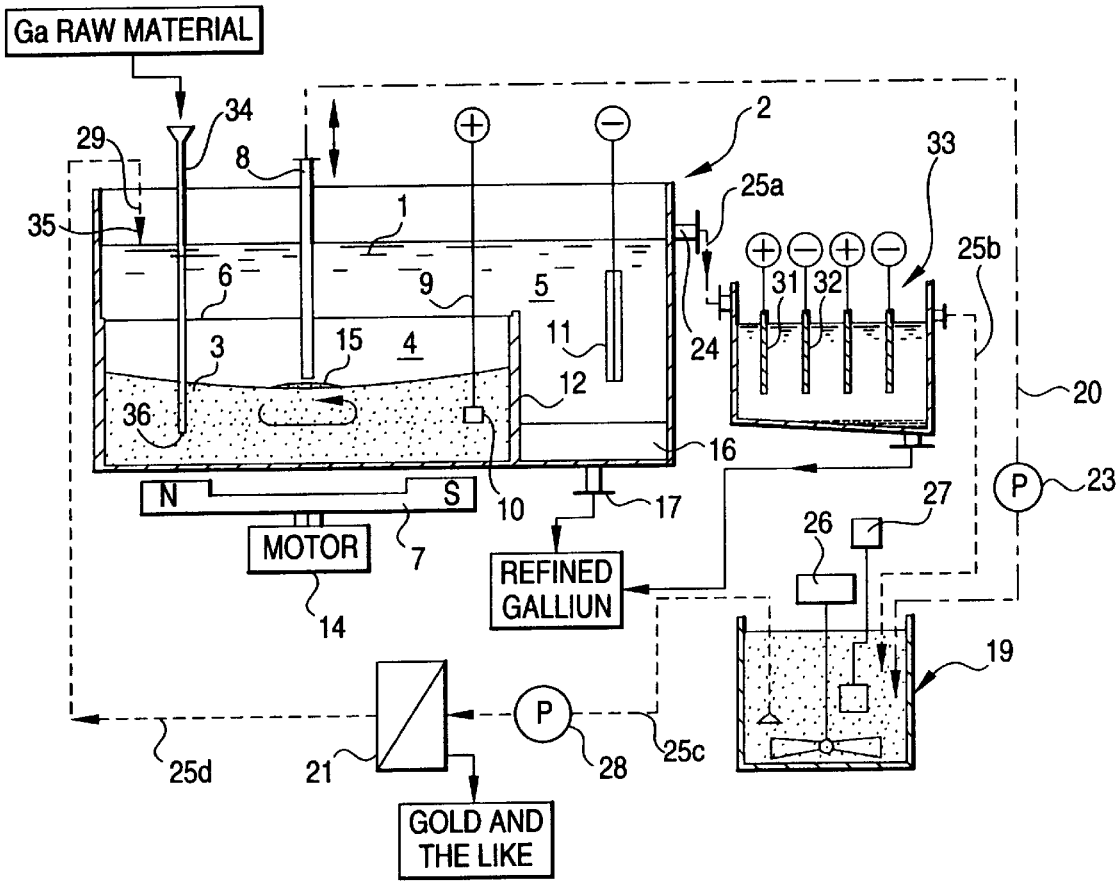
FIG. 3 is a schematic cross-sectional view of another apparatus for conducting the method according to the invention.

FIG. 3 shows an apparatus for use in the electrolytic refining of gallium according to the present similar to that shown in FIGS. 1 and 2, except that it further comprises, on the outside of the electrolytic cell 2, an auxiliary electrolytic cell 33 equipped with insoluble anode 31 and cathode 32, a piping 25 (a, b, c, and d) for circulating the electrolytic solution 1 between the electrolytic cell 2 and an auxiliary electrolytic cell 33, and a raw material supply tube 34 for replenishing the melted raw gallium material to the cylindrical vessel 6 provided inside the anodic chamber 4 during the electrolysis.

In the auxiliary electrolytic cell 33, gallium that is dissolved in the electrolytic solution 1 is allowed to deposit on the cathode 32. Thus, by using the auxiliary electrolytic cell 33 the concentration of gallium in the electrolytic solution 1 is suppressed, and gallium that is present in excess in the electrolytic solution 1 is collected by electrolysis. More specifically, the electrolytic solution fed into the auxiliary electrolytic cell 33 through the piping 25*a* from the overflow outlet 24 of the electrolytic cell 2 is subjected to electrolysis by applying an electric current to the insoluble anode 31 and cathode 32, such that metallic gallium may deposit on the cathode 32 and thereby remove gallium that is present in excess in the electrolytic solution. Because the electrolytic solution is maintained at a temperature not lower than the melting point of gallium, the refined gallium drops down from the cathode 32 to the bottom of the cell, and is collected from a discharge outlet 35 as the refined gallium.

In this manner, in the apparatus shown in FIG. 3, the concentration of the electrolytic solution during the operation of the electrolysis is controlled by the auxiliary electrolytic cell 33. This is attributed to the fact that the concentration of gallium in the electrolytic solution gradually increases with the progress of the electrolysis. From the Coulombic viewpoint, the same load is applied to the anode and the cathode, and hence, the concentration of gallium should be maintained at a constant value because the amount eluted from the anode should be the same as that which form electrodeposits on the cathode. However, from the chemical point of view, gallium elutes at an amount higher than that corresponding to the electric equivalent in a highly alkaline solution maintained at a high temperature; furthermore, at the cathode, the refined gallium that has once formed the electrodeposit undergoes re-dissolution. In this manner, the concentration of gallium in the electrolytic solution increases gradually. If the gallium concentration for the electrolytic solution becomes too high, there is fear of initiating the elution of impurities into the electrolytic solution. Thus, by recovering gallium from the electrolytic solution as deposits on the cathode 32 in the auxiliary electrolytic cell 33, gallium dissolved in excess can be collected as refined gallium. In the auxiliary electrolytic cell 33, the amount of electric current and the time duration of applying the electric current between the insoluble anode 31 and cathode 32 are controlled in such a manner that the concentration of gallium in the electrolytic solution that is discharged from the electrolytic cell 33 may fall in a predetermined range, for instance, from 30 to 150 g/liter, preferably, from 30 to 100 g/liter, and more preferably, from 50 to 60 g/liter. This control can be made automatically.

The electrolytic solution passed through the auxiliary electrolytic cell 33 as described above enters the intermediate cell 19 as above through the piping 25*b*. In the intermediate cell 19, the scum and the electrolytic solution passed through the suction pipe 8 are united with the electrolytic solution supplied from the auxiliary electrolytic cell 33, and while the resulting fluid is remaining in the intermediate cell 19, stirring using the stirrer 26 and heating control using the heater 27 are applied to control the temperature of the electrolytic solution of the entire system. Then, the electrolytic solution is passed from the intermediate cell 19 to the piping 25*c*, the pump 28, the filter 21, and the piping 25*d* to finally return to the electrolytic cell 2. Thus, by passing through the filter 21 during the process, the suspended matter (the scum) is filtered from the fluid. The filtrate obtained on passing through the filter 21 is returned back to the electrolytic cell 2 via the piping 25*d*, and by providing the discharge outlet 35 of the piping 25*d* in the side (i.e., into the cylindrical vessel 6) of the anodic chamber 4, the resulting fluid is fed to the upper portion of the melted raw material 3. By thus ref luxing, the surface level of the electrolytic solution 1 inside the electrolytic cell 2 is maintained at a constant level (i.e., at the level corresponding to the overflow outlet 24) during the electrolysis while keeping the temperature of the electrolytic solution at a predetermined value.

In the electrolytic cell 2 shown in FIG. 3, a raw material supply tube 34 is provided in order to replenish the melted raw gallium material to the cylindrical vessel 6 inside the anodic chamber 4 during the electrolysis. This tube 34 is installed detachable, and in feeding melted raw gallium material, an injecting end 36 is immersed to the melted raw gallium material 3.

The invention is described in further detail by referring to non-limiting Examples below.

EXAMPLE 1

Referring to the apparatus shown in FIGS. 1 and 2, 10 liters of an electrolytic solution having 50 g/liter of Ga and 150 g/liter of NaOH dissolved therein was fed into the electrolytic cell 2, and the pump 28 installed between the electrolytic cell 28 and the intermediate cell 19 was driven to circulate the electrolytic solution at a flow rate of 300 ml/min. A switch of the heater 27 was turned on, and the heat input was controlled with the heater controller in such a manner to maintain the temperature of the electrolytic solution 1 inside the electrolytic cell 2 at 50° C.

Then, after charging 3,000 g of a previously melted raw gallium material 3 into the cylindrical vessel 6 provided inside the anodic chamber 4, the motor 14 was started to rotate the magnet rotator 7 to exert a centrifugal force by causing a revolving flow in the melted raw gallium material 3. While maintaining this state, the suction pipe 8 was adjusted as such that the suction hole provided to the font end thereof would be located at a position about 5 mm higher than the central portion in the surface of the melted raw gallium material 3, and the pump 23 was driven to conduct suction at a flow rate of 150 ml/min. Furthermore, the electrically conductive rod 9 was set in such a manner that the metallic connector 10 provided to the front end thereof would maintain the immersed state in the melted raw gallium material 3. While maintaining this state, an electric current was applied between the melted raw gallium material 3 and the stainless steel cathode plate 11 at a current density of 0.10 A/cm$^2$, and electrolysis was carried out continuously for a duration of 200 hours. The potential between the electrodes was found to occasionally increase slightly from 4.5 to 5.5 V.

During the electrolysis, the feed rate of the pumps 23 and 28 was maintained at about the aforementioned value, and the suction pipe 8 was adjusted as such that it may maintain the vertical position about 5 mm higher than the scum 15 which was concentrated at the central portion. Activated charcoal was used for the filter material of the filter 21.

The results obtained by the operation according to the present example are summarized in Table 1.

TABLE 1

| | Weight | Distribution | Impurity Concentration (ppm) | | | | |
|---|---|---|---|---|---|---|---|
| | (g) | ratio (%) | In | Au | Cu | Pb | Note |
| Raw Ga material | 3,004 | 100.0 | 2,917 | 17.8 | 17 | 2 | Potential between the electrodes changed in 0 to 200 hours from 4.0 to 5.5 V |
| Refined Ga | 2,321 | 77.3 | 5 | <0.1 | <0.5 | <0.5 | |
| Anode slime | 315 | 10.5 | 26,452 | <0.1 | 185 | 23 | |

Note:
Analysis of impurities was conducted by ICP method

From the results shown in Table 1, it can be understood that the amount of the thus obtained refined gallium accounts for about 80% of the amount of raw gallium material. Concerning the impurities contained in refined gallium, it is shown that the concentrations are reduced; more specifically, the concentration of indium is lowered to 5 ppm, that of gold is 0.1 ppm or lower, and those of copper and lead are each reduced to 0.5 ppm or lower. Thus, gallium is obtained at a purity level of 5 N (99.999%).

EXAMPLE 2

Electrolysis was performed in the same manner as that conducted in Example 1, except for changing the current density to 0.05 A/cm$^2$. The results obtained by the operation according to this Example are summarized in Table 2.

TABLE 2

| | Weight (g) | Distribution ratio (%) | Impurity Concentration (ppm) In | Au | Cu | Pb | Note |
|---|---|---|---|---|---|---|---|
| Raw Ga material | 3,001 | 100.0 | 2,917 | 17.8 | 17 | 2 | Potential between the electrodes changed in 0 to 200 hours from 3.0 to 3.5 V |
| Refined Ga | 1,135 | 37.8 | 2 | <0.1 | <0.5 | <0.5 | |
| Anode slime | 1,646 | 54.8 | 5,523 | <0.1 | 31 | 3 | |

Note:
Analysis of impurities was conducted by ICP method

From the results shown in Table 2, it can be understood that, in this Example in which the current density was halved to that employed in Example 1, the amount of refined gallium accounts for about 40% of the raw gallium material, but the increase in potential between the electrodes during conducting the electrolysis was small. Thus, it was found that the electrolysis can further be sufficiently continued. Concerning the impurities contained in refined gallium, it is shown that the concentrations are reduced; more specifically, the concentration of indium is lowered to 2 ppm, that of gold is 0.1 ppm or lower, and those of copper and lead are each reduced to 0.5 ppm or lower. It can be understood that gallium having a higher purity is obtained, but the productivity was ½ of the case described in Example 1.

COMPARATIVE EXAMPLE 1

Electrolysis was performed in the same manner as that conducted in Example 1, except that the magnetic rotator 7 was not rotated (i.e., the motor 14 was not driven) and that no liquid was sucked from the suction pipe 8 (i.e., the pump 23 was stopped). That is, no centrifugal force was applied to the raw liquid material, no scum was discharged, and the filter 21 was not used during the electrolysis. As a result, the voltage was found to abruptly increase and the electrolysis was stopped after conducting the electrolysis for a duration of 120 hours. On observing the raw melted material inside the cylindrical vessel, it was found that the color of the surface was uniformly changed, and that an oxide film completely covered the surface. The results obtained after operation for 120 hours are given in Table 3.

TABLE 3

| | Weight (g) | Distribution ratio (%) | Impurity Concentration (ppm) In | Au | Cu | Pb | Note |
|---|---|---|---|---|---|---|---|
| Raw Ga material | 3,003 | 100.0 | 2,917 | 17.8 | 17 | 2 | Potential between the electrodes changed in 0 to 120 hours from 4.1 to 3.5 V; 12 V at stopping the electrolysis |
| Refined Ga | 1,315 | 43.8 | 12 | 5.3 | 1 | <0.5 | |
| Anode slime | 1,455 | 48.5 | 6,228 | <0.1 | 40 | 3 | |

Note:
Analysis of impurities was conducted by ICP method

From the results shown in Table 3, it can be understood that the electrolysis was stopped at the point the anode slime was reduced to 50%. The refined gallium accounted for only about over 40%. Concerning the concentrations of the impurities, that of indium, gold, and copper were 12 ppm, 5.3 ppm, and 1 ppm, respectively; they were all higher than those obtained in Examples 1 and 2. In particular, the removal of gold was found to be insufficient.

EXAMPLE 3

By using the apparatus shown in FIG. 3, 35 liters of an electrolytic solution having 50 g/liter of Ga and 150 g/liter of NaOH dissolved therein was charged into the electrolytic cell 2, and the electrolytic solution was circulated at a flow rate of 300 ml/min from the electrolytic cell 2 to the auxiliary electrolytic cell 33, then to the intermediate cell 19, and returned back to the electrolytic cell 2 by operating the pump 28. Then, the heater 27 and the stirrer 26 were switched on in the intermediate cell 19, and the heat input using the heater 27 was controlled by using the controller of the heater in such a manner that the temperature of the electrolytic solution in the electrolytic cell 2 is maintained at 50° C.

Then, 10 kg of a previously melted raw gallium material 3 was charged into the cylindrical vessel 6 provided to the anodic chamber 4, and the motor 14 was operated to rotate the magnet rotator 7 so as to exert a centrifugal force to the melted raw gallium material 3 by allowing a revolving flow to occur therein. While maintaining this state, the suction pipe 8 was adjusted as such that the suction hole provided to the front end thereof would be located at a position about 5 mm higher than the central portion in the surface of the melted raw gallium material 3, and the pump 23 was driven to conduct suction at a flow rate of 150 ml/min. Furthermore, the electrically conductive rod 9 was set in such a manner that the metallic connector 10 provided to the front end thereof would maintain the immersed state in the melted raw gallium material 3. While maintaining this state, an electric current was applied between the melted raw gallium material 3 and the stainless steel cathode plate 11 at a current density of 0.10 A/cm$^2$, and electrolysis was carried out continuously for a duration of 879 hours. During the electrolysis, a melted raw gallium material was replenished 24 times to amount for 43.7 kg in total. In the auxiliary electrolytic cell 33, an electric current was applied and stopped at a current value of 6 A to conduct electrolytic collection of gallium, so that the gallium concentration in the electrolytic solution should fall in a range of from 50 to 60 g/liter.

During the electrolysis, the feed rate of the solution for pumps 23 and 28 was maintained at about the same value, and the suction pipe 8 was adjusted as such that it may maintain the vertical position about 5 mm higher than the scum 15 gathered at the central portion. Activated charcoal was used for the filter material of the filter 21.

The results obtained by the operation according to this Example are summarized in Table 4.

TABLE 4

| | Weight | Distribution | Impurity Concentration (ppm) | | | |
|---|---|---|---|---|---|---|
| | (kg) | ratio (%) | In | Au | Cu | Pb |
| Raw Ga material | 53.7 | 100.0 | 4,600 | 10.3 | 17 | 1 |
| Refined Ga (in the electrolytic cell) | 43.4 | 80.8 | 7 | <0.1 | <0.5 | <0.5 |
| Refined Ga (in the auxiliary electrolytic cell) | 4.3 | 8.0 | 6 | <0.1 | <0.5 | <0.5 |
| Anode slime | 6.3 | 11.7 | 41,200 | <0.1 | 185 | 13 |

Note:
Analysis of impurities was conducted by ICP method

From the results shown in Table 4, it can be understood that the amount of the thus obtained refined gallium in the electrolytic cell 2 and the auxiliary electrolytic cell 33 in total accounts for about 90% of the amount of raw gallium, but it was still possible to continue the electrolysis. Concerning the impurities contained in refined gallium, it is shown that the concentrations are reduced; more specifically, the concentration of indium is lowered to 7 ppm, that of gold is 0.1 ppm or lower, and those of copper and lead are each reduced to 0.5 ppm or lower. Thus, gallium is obtained at a purity level of 4 to 5 N (99.999%).

EXAMPLE 4

The same process was carried out as in the procedure described in Example 3, except for using a raw gallium containing impurities at a higher concentration. The duration of electrolysis, however, was 395 hours in total. During the operation, a melted raw gallium material was replenished 10 times which amounted to 12.2 kg in total. The results obtained by the operation are summarized in Table 5.

TABLE 5

| | Weight | Distribution | Impurity Concentration (ppm) | | | |
|---|---|---|---|---|---|---|
| | (kg) | ratio (%) | In | Au | Cu | Pb |
| Raw Ga material | 24.2 | 100.0 | 78,500 | <0.1 | 33 | 20 |
| Refined Ga (in the electrolytic cell) | 19.8 | 81.8 | 780 | <0.1 | <0.5 | <0.5 |
| Refined Ga (in the auxiliary electrolytic cell) | 2.0 | 8.3 | 820 | <0.1 | <0.5 | <0.5 |
| Anode slime | 2.2 | 9.1 | 875,000 | <0.1 | 485 | 240 |

Note:
Analysis of impurities was conducted by ICP method

Table 5 shows the results obtained as a result of conducting electrolysis on a raw gallium material particularly high in indium concentration to concentrate indium in the melted raw gallium material of the anode up to its concentration limit. It can be understood that indium in the anode slime is concentrated to about 88%. In the vicinity of the completion of the electrolysis, the anode exhibited a gray-colored solid state except for the vicinity of the electrically conductive rod 9. Although the concentration of indium in the refined gallium was found to be about 800 ppm, those of copper and lead were each below the detection limit. From the results above, it can be understood that the method according to the invention is effective in refining a raw gallium material particularly high in indium concentration.

EXAMPLE 5

The same process was performed in the same manner as in the procedure described in Example 3, except for use in the refined gallium obtained in Example 4 as the raw material. The electrolysis was conducted continuously for a duration in total of 360 hours, and the raw material was replenished for 10 times in liquid state to amount for 11.8 kg in total. The results obtained by the operation are summarized in Table 6.

TABLE 6

| | Weight | Distribution | Impurity Concentration (ppm) | | | |
|---|---|---|---|---|---|---|
| | (kg) | ratio (%) | In | Au | Cu | Pb |
| Raw Ga material | 21.8 | 100.0 | 785 | <0.1 | <0.5 | <0.5 |
| Refined Ga (in the electrolytic cell) | 17.8 | 81.7 | 1.3 | <0.1 | <0.5 | <0.5 |
| Refined Ga (in the auxiliary electrolytic cell) | 1.8 | 8.3 | 1.8 | <0.1 | <0.5 | <0.5 |
| Anode slime | 2.1 | 9.6 | 7,200 | <0.1 | 3.8 | 1 |

Note:
Analysis of impurities was conducted by ICP method

From the results shown in Table 6, it can be understood that the concentrations of the impurities are reduced; more specifically, the concentration of indium is lowered to 2 ppm or lower, and those of copper and lead are each reduced to 0.5 ppm or lower. Thus, gallium is obtained at a purity level of 5 N (99.999%). Furthermore, refined gallium obtained from the electrolytic cell 2 and the auxiliary electrolytic cell 20 in total amounted to a recovery of near 90%.

Concerning that the anode slime obtained in Example 4 contains indium at high concentration, it can be understood that, by combining Example 4 and 5, indium can be separated at high efficiency from a raw gallium material containing indium at high concentration as to obtain gallium with high purity.

From the Examples described above, in a practical operation, a production line having an extremely high productivity can be realized by combining the examples above. For instance, in case of producing gallium having a purity level of 5 N from a raw gallium material containing 2,000 ppm of indium as the impurity, 90 kg of refined gallium is obtained from the process described in Example 3. Then, from 10 kg of gallium contained in the anode slime containing indium concentrated to 20,000 ppm, 9.7 kg of gallium can be obtained at a purity level of 3N by performing the process described in Example 4. About 0.3 kg of the remaining portion containing the impurities concentrated to 80% is breed off, and is subjected to the recovery of gallium therefrom by applying a different method thereto. The 9.7 kg portion of the 3N gallium is recycled to the first process step, and about 8.8 kg of gallium having a purity level of 5 N is recovered therefrom. Conclusively, gallium having a purity level of 5 N can be recovered at an yield of 98.8% from those consecutive processes.

COMPARATIVE EXAMPLE 2

Electrolysis was performed in the same manner as that conducted in Example 3, except that the electrolytic collection in the auxiliary electrolytic cell 33 was not conducted, the magnetic rotator 7 was not rotated (i.e., the motor 14 was not driven) and that no liquid was sucked from the suction pipe (i.e., the pump 23 was stopped). That is, no centrifugal force was applied to the raw liquid material, no scum was discharged, and the filter 21 was not used during the electrolysis. The change in concentration of gallium in the electrolytic solution and the current efficiency as well as the change in indium concentration in the electrolytic solution with respect to the change in gallium concentration were measured. The results obtained after the operation are given in Table 7.

TABLE 7

| Ga concentration in the electrolytic solution (g/liter) | In concentration in the electrolytic solution (g/liter) | Current efficiency (%) |
|---|---|---|
| 25 | <0.1 | 58.8 |
| 60 | <0.1 | 92.7 |
| 150 | 2.0 | 97.6 |

From the results shown in Table 7, it can be understood that the current efficiency is impaired unless the gallium concentration in the electrolytic solution is maintained in a proper range, and that indium elutes into the electrolytic solution.

As described in detail in the foregoing, the invention enables the removal of impurities such as gold, which was not possible in the related art electrolytic refining methods for gallium, while increasing the concentration degree of impurities in the anode slime and prolonging the life of electrolysis. Accordingly, the yield of refined gallium can be improved, thereby ameliorating the refining efficiency. Thus, the invention is greatly contributive to refining gallium from the raw gallium material produced from the smelting process of zinc or from crude gallium recovered from the compound semiconductor scraps. Furthermore, the method is of high contribution in refining gallium from the raw gallium material containing impurities at high level which generates in the refining process of high purity gallium.

What is claimed is:

1. An electrolytic refining method for gallium by depositing refined gallium as a deposit on a cathode in an electrolytic solution using a melted raw gallium material as an anode in an electrolytic cell, which comprises applying a centrifugal force to the melted raw gallium material and discharging out a scum gathered in the central portion of the cell.

2. An electrolytic refining method for gallium as claimed in claim 1, wherein the centrifugal force is applied by using a magnetic field.

3. An electrolytic refining method for gallium as claimed in claim 1, wherein the scum is discharged to the outside of the cell together with a part of the electrolytic solution, and the scum is separated from the electrolytic solution by using a filter.

4. An electrolytic refining method for gallium by depositing refined gallium as a deposit on a cathode in an electrolytic solution using a melted raw gallium material as an anode in an electrolytic cell, which comprises an operation of discharging a scum generated on the surface of the anode and an operation of supplying the melted raw gallium material to the anode until the completion of the electrolysis.

5. An electrolytic refining method for gallium by depositing refined gallium as a deposit on a cathode in an electrolytic solution using a melted raw gallium material as an anode in an electrolytic cell, which comprises an operation of discharging a scum generated on the surface of the anode, an operation of supplying the melted raw gallium material to the anode until the completion of the electrolysis, and an operation of maintaining the concentration of gallium in the electrolytic solution within a predetermined range during the electrolysis.

6. An electrolytic refining method for gallium as claimed in claim 5, wherein the operation of maintaining the concentration of gallium in the electrolytic solution within a predetermined range during the electrolysis comprises circulating the electrolytic solution inside an electrowinning cell installed outside the electrolytic cell and depositing gallium on the cathode of said electrowinning cell.

7. An apparatus for use in electrolytic refining of gallium, which comprises an electrolytic cell into which is charged an electrolytic solution maintained at a temperature not lower than the melting point of gallium, the electrolytic cell comprising anodic chamber for containing a melted raw gallium material as an anode and a cathodic chamber for collecting refined gallium deposited in a cathode, and the anodic chamber and the cathodic chamber being partitioned from each other such that the electrolytic solution is communicated between the chambers, wherein the anodic chamber is constructed by a cylindrical vessel for containing the melted raw gallium material;

a magnet rotator is provided at a lower side and outside of the cylindrical vessel; and a suction pipe is placed in a central portion inside of the cylindrical vessel.

8. An apparatus for use in electrolytic refining of gallium, which comprises an electrolytic cell into which is charged an electrolytic solution maintained at a temperature not lower than the melting point of gallium, the electrolytic cell comprising anodic chamber for containing a melted raw gallium material as an anode and a cathodic chamber for collecting refined gallium deposited in a cathode, and the anodic chamber and the cathodic chamber being partitioned from each other such that the electrolytic solution is communicated between the chambers, wherein the anodic chamber is constructed by a cylindrical vessel for containing the melted raw gallium material;

a magnet rotator is provided at a lower side and outside of the cylindrical vessel; and a suction pipe is placed in a central portion inside of the cylindrical vessel, the suction pipe is connected to an intermediate cell provided at the outside of the electrolytic cell, and a piping connecting from the intermediate cell to the electrolytic cell via a filter is provided.

9. An apparatus for use in electrolytic refining of gallium, which comprises an electrolytic cell into which is charged an electrolytic solution maintained at a temperature not lower than the melting point of gallium, the electrolytic cell comprising anodic chamber for containing a melted raw gallium material as an anode and a cathodic chamber for collecting refined gallium deposited in a cathode, and the anodic chamber and the cathodic chamber being partitioned from each other such that the electrolytic solution is communicated between the chambers, wherein the anodic chamber is constructed by a cylindrical vessel for containing the melted raw gallium material;

a magnet rotator is provided at a lower side and outside of the cylindrical vessel;

a suction pipe is placed in a central portion inside of the cylindrical vessel;

an auxiliary electrolytic cell having an insoluble cathode and an anode is provided outside the electrolytic cell; and a circuit for circulating the electrolytic solution between the electrolytic cell and the auxiliary electrolytic cell is provided.

10. An apparatus for use in electrolytic refining of gallium, which comprises an electrolytic cell into which is charged an electrolytic solution maintained at a temperature not lower than the melting point of gallium, the electrolytic cell comprising anodic chamber for containing a melted raw gallium material as an anode and a cathodic chamber for collecting refined gallium deposited in a cathode, and the anodic chamber and the cathodic chamber being partitioned from each other such that the electrolytic solution is communicated between the chambers, wherein the anodic chamber is constructed by a cylindrical vessel for containing the melted raw gallium material;

a magnet rotator is provided at a lower side and outside of the cylindrical vessel;

a suction pipe is placed in a central portion inside of the cylindrical vessel;

an auxiliary electrolytic cell having an insoluble cathode and an anode is provided outside the electrolytic cell;

a circuit for circulating the electrolytic solution between the electrolytic cell and the auxiliary electrolytic cell is provided;

an intermediate cell is provided in the circulating circuit;

the intermediate cell is connected with the suction pipe; and a filter is incorporated in the piping connecting from the intermediate cell to the electrolytic cell.

* * * * *